US008416166B2

(12) United States Patent
Shin et al.

(10) Patent No.: US 8,416,166 B2
(45) Date of Patent: Apr. 9, 2013

(54) LIQUID CRYSTAL DISPLAY DEVICE

(75) Inventors: Dong Uk Shin, Gumi-si (KR); Kyung Tae Park, Gumi-si (KR); Chang Yeop Shin, Gumi-si (KR); Yun Jung Hwang, Gosu 5-ri (KR); Wan Jin Seo, Gumi-si (KR)

(73) Assignee: LG Display Co. Ltd., Seoul (KR)

( * ) Notice: Subject to any disclaimer, the term of this patent is extended or adjusted under 35 U.S.C. 154(b) by 865 days.

(21) Appl. No.: 12/540,917

(22) Filed: Aug. 13, 2009

(65) Prior Publication Data

US 2010/0156770 A1 Jun. 24, 2010

(30) Foreign Application Priority Data

Dec. 24, 2008 (KR) ..... 10-2008-0133956

(51) Int. Cl.
*G09G 3/36* (2006.01)

(52) U.S. Cl. ..... 345/87; 345/98; 345/204

(58) Field of Classification Search ..... 345/87–100, 345/204; 346/40
See application file for complete search history.

(56) References Cited

U.S. PATENT DOCUMENTS 6,043,971 A * 3/2000 Song et al. ..... 361/111
6,587,160 B2 * 7/2003 Lee et al. ..... 349/40
8,154,674 B2 * 4/2012 Chung et al. ..... 349/40
2007/0091218 A1 * 4/2007 Huang et al. ..... 349/40
2007/0131989 A1 * 6/2007 Liu et al. ..... 257/291
2008/0212245 A1 * 9/2008 Choi ..... 361/56

FOREIGN PATENT DOCUMENTS

JP 2005-093459 4/2005
KR 100218148 B1 6/1999

OTHER PUBLICATIONS

Office Action issued in corresponding Korean Patent Application No. 9-5-2012-024708448, mailed Apr. 27, 2012.

* cited by examiner

*Primary Examiner* — Viet Pham

(74) *Attorney, Agent, or Firm* — Brinks Hofer Gilson & Lione

(57) ABSTRACT

An LCD device adapted to prevent a malfunction caused by an electrical current leaking through an electrostatic discharger is disclosed. The LCD device includes the floating line disposed between common line and gate lines or data lines. Electrostatic dischargers are connected between the common line and the floating line as well as between the floating line and the gate lines or the data lines. As such, the LCD device blocks the leakage current caused by the common voltage on the common line from flowing through the electrostatic dischargers. Therefore, the LCD device prevents the increase of electric current consumption and a horizontal defect.

10 Claims, 3 Drawing Sheets

LIQUID CRYSTAL DISPLAY DEVICE

RELATED APPLICATIONS

This application claims priority under 35 U.S.C. 119 to Korean Patent Application No. 10-2008-0133956, filed on Dec. 24, 2008, which is hereby incorporated by reference in its entirety.

BACKGROUND

1. Field of the Disclosure

This disclosure relates to a liquid crystal display (LCD) device adapted to prevent a malfunction caused by an electrical current leaking through an electrostatic discharger.

2. Description of the Related Art

As the information society grows, display devices capable of displaying information have been widely developed. These display devices include liquid crystal display (LCD) devices, organic electro-luminescence display (OLED) devices, plasma display devices, and field emission display devices.

Among the above display devices, LCD devices have the advantages that they are light and small and can provide a low power drive and a full color scheme. Accordingly, LCD devices have been widely used for mobile phones, navigation systems, portable computers, televisions and so on. Such LCD devices control the transmittance of a liquid crystal on a liquid crystal panel, thereby displaying a desired image.

FIG. 1 is a view showing an LCD device of the related art. As shown in FIG. 1, an LCD device 100 of the related art includes a first substrate 110, a second substrate (not shown), and a liquid crystal layer (not shown) interposed between the first substrate 110 and the second substrate.

The first substrate 110 is defined as a display area 140 for displaying an image and a non-display area 150 not displaying any image. The first substrate 110 includes a plurality of gate lines G1 through Gn and a plurality of data lines D1 through Dm which are arranged to cross each other. The ends of one side of the gate lines G1~Gn are connected to gate pads 112, respectively, and the ends of one side of the data lines D1~Dm are also connected to data pads 114. The gate pads 112 and the data pads 114 are all arranged on the non-display area 150.

The crossing of the gate lines G1~Gn and the data lines D1~Dm defines a plurality of pixel regions P. These pixel regions P are arranged in a matrix shape on the display area 140. A thin film transistor 116, a pixel electrode (not shown), a storage capacitor Cst, and a liquid crystal capacitor Clc are formed in each of the pixel regions P.

In the non-display area 150, a common line 120 is disposed along the periphery of the display area 140. A silver dot 122 is formed on a corner portion of the common line 120. The silver dot 122 is electrically connected to a common electrode (not shown) disposed on the second substrate.

A plurality of first electrostatic dischargers 130 can be connected between the common line 120 and the gate lines G1~Gn. A plurality of second electrostatic dischargers 132 can be connected between the common line 120 and the data lines D1~Dm. The first and second electrostatic dischargers 130 and 132 allow static electricity externally applied to the common line 120 to flow to the gate lines G1~Gn or the data lines D1~Dm. On the contrary, the first and second electrostatic dischargers 130 and 132 allow static electricity on the gate lines G1~Gn or the data lines D1~Dm to flow to an external circuit (not shown) or to the common electrode of the second substrate through the common line 120.

The first and second electrostatic dischargers 130 and 132 generally include a transistor and the common line 120 always receives a common voltage. As such, the common voltage applied to the common line 120 forces an electric current to leak through the first and second electrostatic dischargers 130 and 132.

This leakage current may be applied to the gate lines G1~Gn or the data lines D1~Dm. In this case, the pixel regions P are driven by the leaked electric current applied to the gate lines G1~Gn or the data lines D1~Dm, thereby causing a horizontal line defect. The horizontal line defect becomes more severe in high temperatures. In addition, the leakage current causes an increase in the electric current consumption of a common voltage supplier (not shown) which generates the common voltage.

BRIEF SUMMARY

According to one general aspect of the present embodiment, an LCD device includes: a plurality of gate lines and a plurality of data lines arranged to cross each other on a display area; a floating line disposed along the periphery of the display area to maintain a floating state; a common line disposed along the periphery of the floating line to apply a common voltage; a plurality of first electrostatic dischargers connected between the common line and the floating line; a plurality of second electrostatic dischargers connected between the floating line and the gate lines; and a plurality of third electrostatic dischargers connected between the floating line and the data lines.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION OF THE DRAWINGS AND THE PRESENTLY PREFERRED EMBODIMENTS

Figure 1:
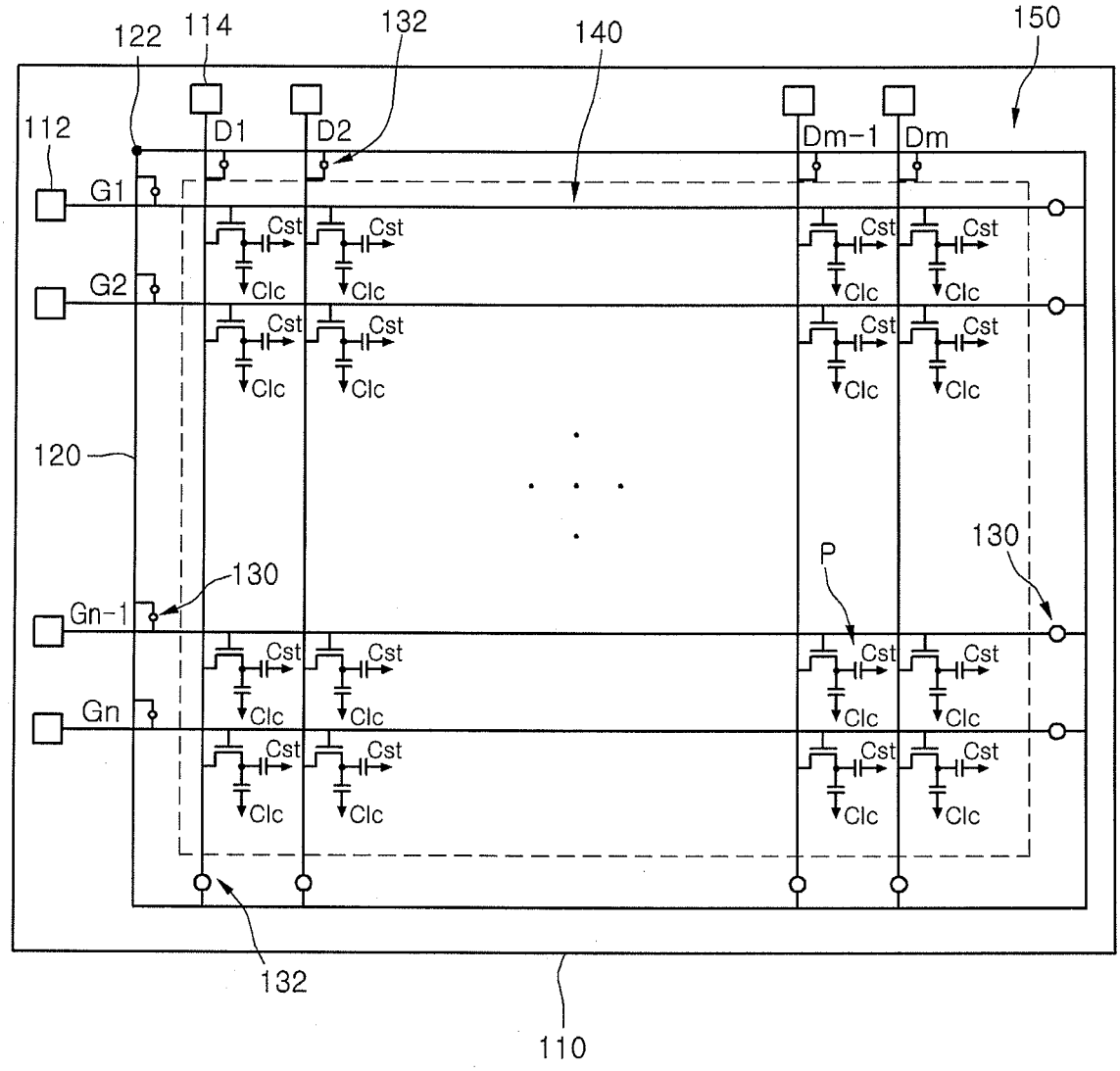
FIG.1 Related Art
FIG. 1 is a view showing an LCD device of related art.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 2:
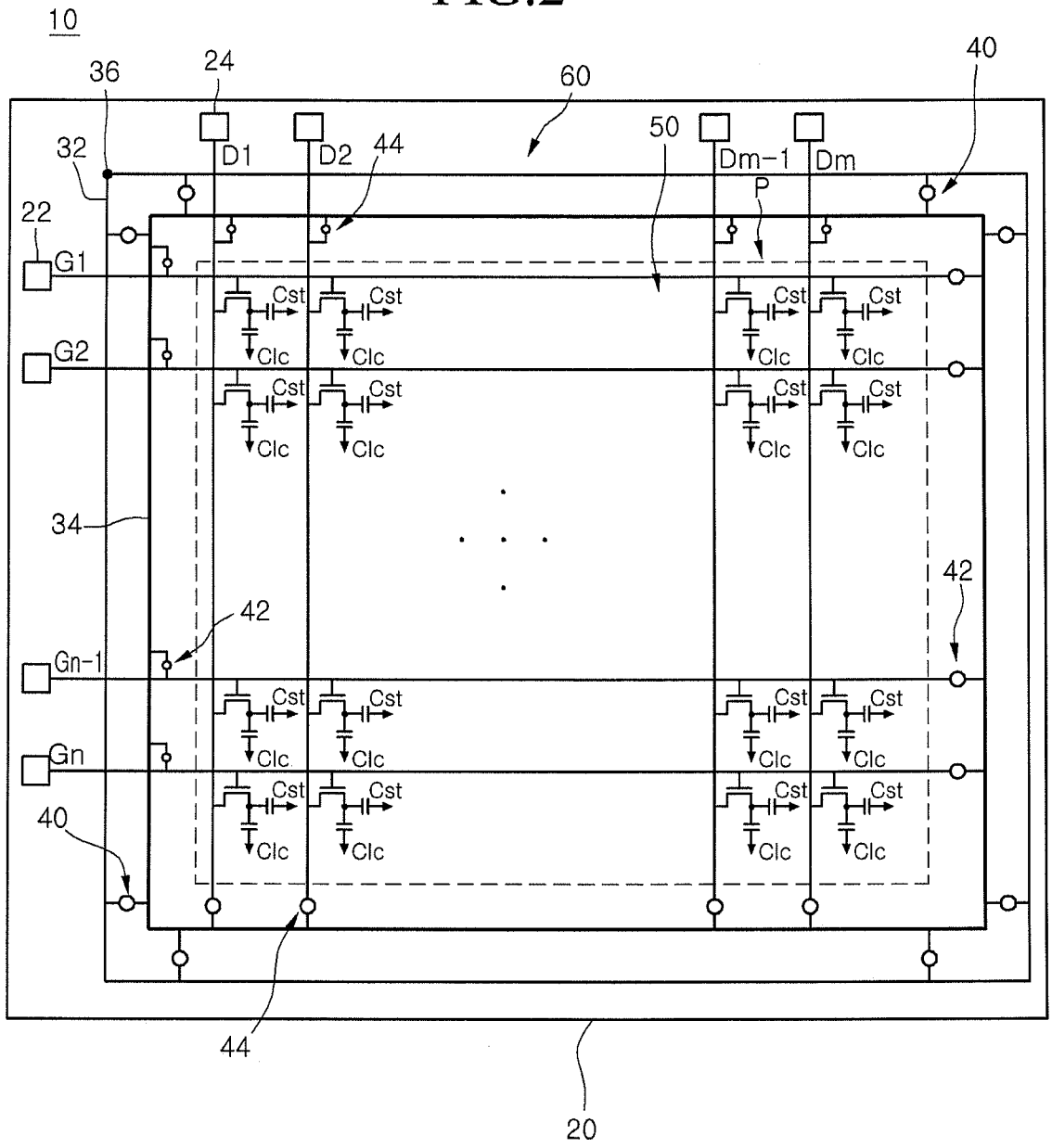
FIG. 2 is a view showing an LCD device according to an embodiment of the present disclosure.

FIG. 2 is a view showing an LCD device of the related art. Referring to FIG. 2, an LCD device 10 of the related art includes a first substrate 20, a second substrate (not shown), and a liquid crystal layer (not shown) interposed between the first substrate 20 and the second substrate.

The first substrate 20 is defined as a display area 50 for displaying an image and a non-display area 60 not displaying any image. The first substrate 20 includes a plurality of gate lines G1 through Gn and a plurality of data lines D1 through Dm which are arranged to cross each other. The ends of one side of the gate lines G1~Gn are connected to gate pads 22, respectively, and the ends of one side of the data lines D1~Dm are connected to data pads 24. The gate pads 22 and the data pads 24 are all arranged on the non-display area 60.

The gate lines G1~Gn are arranged on the display area 50 as well as on the non-display area 60 from the display area 50 to the gate pads 22. Alternatively, the gate lines G1~Gn can be arranged only on the display area 50. In this case, gate link lines (not shown) between the gate lines G1~Gn and the gate pads 22 may be arranged on the non-display area 60.

The data lines D1~Dm are arranged on the display area 50 as well as on the non-display area from the display area 50 to the data pads 24. Alternatively, the data lines D1~Dm can be arranged only on the display area 50. In this case, data link lines (not shown) may be arranged between the data lines D1~Dm and the data pads 24 on the non-display area 60.

The crossing of the gate lines G1~Gn and the data lines D1~Dm defines a plurality of pixel regions P. These pixel regions P are arranged in a matrix shape on the display area 50. A thin film transistor 26, a pixel electrode (not shown), a storage capacitor Cst, and a liquid crystal capacitor Clc are formed in each of the pixel regions P.

The thin film transistor 26 is connected to the respective gate line G and the respective data line D. The pixel electrode may be connected to the respective transistor 26. The storage capacitor Cst is formed, between the pixel electrode and the previous gate line, to have an insulation film (not shown) as a medium. The storage capacitor Cst allows the data voltage to be maintained during one frame period. The liquid crystal capacitor Clc can include liquid crystal molecules of the liquid crystal layer to which the data voltage is applied. The liquid crystal capacitor Clc may charge a different voltage according to the pixel region P because the data voltage is differently applied to each pixel region P.

A floating line 34 can be disposed on the non-display area along the periphery of the display area 50. No electric current can flow through the floating line 34 because no voltage is applied to the floating line 34. In view of this point, the floating line 34 may be a member which prevents (or hinders) the electric current from flowing through it. The floating line 34 is also formed to be a closed loop. Accordingly, the floating line 34 can be formed in a single body along the periphery of the display area 50.

On the non-display area 60, a common line 32 is disposed along the periphery of the floating line 34. The common line 32 is formed in a closed loop. As such, the common line 32 can be formed in a single body along the periphery of the floating line 34. Such a common line 32 receives a common voltage generated in a common voltage supplier (not shown).

Silver (Ag) dots 36 are formed on the corner portions of the common line 32. The silver dots 36 are electrically connected to a common electrode (not shown) disposed on the second substrate. Alternatively, the silver dots 36 can be randomly formed on the common line except its corner portions. As such, the common voltage applied to the common line 32 is supplied to the common electrode disposed on the second substrate through the silver dots 36.

In the LCD device of the present embodiment, a plurality of first electrostatic dischargers 40 are connected between the common line 32 and the floating line 34. More specifically, the first electrostatic dischargers 40 may be connected only between the corner portions of the common line 32 and the floating line 34. However, the LCD device of the present embodiment is not limited to this. In other words, the first electrostatic dischargers 40 may be connected between the common line 32 and the floating line 34 at points which are parallel to each other as well as the corner portions.

A plurality of second electrostatic dischargers 42 may be connected between the floating line 34 and the gate lines G1~Gn. A plurality of third electrostatic dischargers 44 may be connected between the floating line 34 and the data lines D1~Dm.

More specifically, a second electrostatic discharger 42 may be connected between the floating line 34 and the first gate line G1. An additional second electrostatic discharger 42 may be connected between the floating line 34 and the second gate line G2. In this manner, an nth second electrostatic discharger 42 may be connected between the floating line 34 and the nth gate line Gn. To rectify this, the second electrostatic dischargers 42 corresponding to the number of the gate lines G1~Gn may be connected to the floating line 34.

Similarly, a third electrostatic discharger 44 may be connected between the floating line 34 and the first data line D1. An additional third electrostatic discharger 44 may be connected between the floating line 34 and the second data line D2. In this manner, an mth third electrostatic discharger 44 may be connected between the floating line 34 and the mth data line Dm. In other words, the third electrostatic dischargers 44 corresponding to the number of the data lines D1~Dm are connected to the floating line 34.

Figure 3:
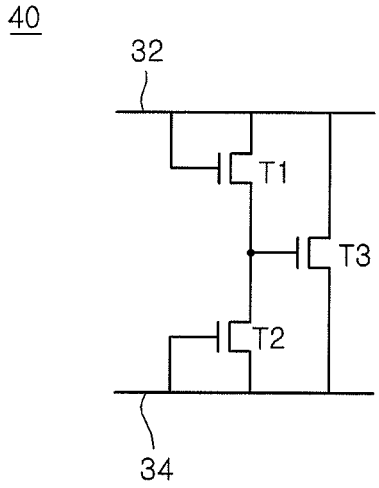
FIG. 3 is a circuit diagram showing the first static electricity discharging element shown in FIG. 2.

The first to third electrostatic dischargers 40, 42, and 44 each can consist of three transistors T1 to T3, as shown in FIG. 3. However, the first to third electrostatic dischargers 40, 42, and 44 according to the present embodiment are not limited to the configuration including three transistors shown in FIG. 3. Alternatively, the first to third electrostatic dischargers 40, 42, and 44 each can be configured to include four transistors or a plurality of transistors.

The first to third electrostatic dischargers 40, 42, and 44 have more superior discharge ability as they are each configured to include more transistors. However, if the electrostatic dischargers 40, 42, and 44 include many transistors, they become larger in size and require a complex manufacturing process and a higher cost. In view of these points, the electrostatic dischargers 40, 42, and 44 may be configured to include an optimized number of transistors.

FIG. 3 is a circuit diagram showing the first electrostatic discharger shown in FIG. 1. The first electrostatic discharger 40 can include first to third transistors T1~T3, as shown in FIG. 3.

The first transistor T1 includes gate and source terminals, connected to a common line 32, and a drain terminal connected to a node n. The second transistor T2 includes gate and source terminals, commonly connected to a floating line 34, and a drain terminal connected to the node n. The third transistor T3 may include a gate terminal connected to the node n, a source terminal connected to the common line 32, and a drain terminal connected to the floating line 34. Such first to third transistors T1~T3 are designed to have a threshold voltage high enough to be turned on by static electricity.

If static electricity is applied to the common line 32, the first transistor T1 is turned on (or activated) by the static electricity, thereby allowing the static electricity applied to the common line 32 to be supplied to the node n through the first transistor T1. Then, the third transistor T3 is also turned on (or activated) by the static electricity supplied to the node n and enables the static electricity supplied from the common line 32 to be applied to the floating line 34. In general, static electricity temporally has a few hundred million units of voltage. As such, the static electricity on the floating line 34 forces an electric current to flow through the floating line 34, even though the floating line 34 prevents the flowing of electric current. Accordingly, the static electricity on the floating line 34 can be applied to gate lines G1~Gn and data lines D1~Dm through second and third electrostatic dischargers 42 and 44 which are connected to the floating line 34.

On the contrary, when static electricity is applied to the gate lines G1~Gn or the data lines D1~Dm, it is transferred to the floating line 34 through the second electrostatic dischargers 42 or the third electrostatic dischargers 44. The static electricity applied to the floating line 34 forces an electric current to flow through the floating line 34 despite the fact that the floating line 34 generally prevents (or hinders) the flowing of electric current. Then, the second transistor T2 is turned on (or activated) by the static electricity applied to the floating line 34 and allows the static electricity on the floating line 34 to be transferred to the node n. The transferred static electricity on the node n turns on (or activates) the third transistor T3, thereby allowing the static electricity on the floating line 34 to be supplied to the common line 32 through the third transistor T3. The static electricity supplied to the common line 32 may be applied to the common electrode of a second substrate or an external circuit through silver dots.

In this manner, the first to third electrostatic dischargers 40, 42, and 44 of the present embodiment safely discharge static electricity to either the exterior or the interior of the LCD device 10. Accordingly, the thin film transistors 26 and the external circuitry can be protected, even though static electricity is induced.

On the other hand, a common voltage of several voltage levels is applied to the common line 32, even though static electricity is not induced. In this case, a leakage of electric current flows through the first electrostatic dischargers 40.

In the related art LCD device, as shown in FIG. 1, the increase of electric current consumption and the horizontal line defect are caused by the flowing of electric current through the electrostatic dischargers. Similarly, when the common voltage is applied to the common line 32, the leakage of electric current may also be caused by the first electrostatic dischargers 40 of the present embodiment. Such a leakage of electric current may be applied to the floating line 34.

However, the floating line 34 prevents the flow of electric current because no voltage is applied to it and a floating state is maintained. To rectify this, the floating line 34 blocks the leakage of electric current from flowing through it in order to prevent the leakage current from being supplied to the second and third electrostatic dischargers 42 and 44, even though the leakage current is applied to the floating line 34.

As such, the leakage of electric current generated in the first electrostatic dischargers 40 is not applied to any of the gate lines G1~Gn or the data lines D1~Dm via the second or third electrostatic dischargers 42 or 44. Therefore, electric current consumption does not increase as the common voltage on the common line 32 is originally maintained. Also, since the leakage current is not applied to the gate lines G1~Gn or the data lines D1~Dm, the horizontal line defect is not caused. Such a floating line can be disposed around the common line 32.

As described above, the LCD device according to the embodiment of the present disclosure includes the floating line disposed between the common line and the gate and/or data lines, thereby preventing the leakage current caused by the common voltage on the common line from flowing through the electrostatic dischargers. Therefore, the electric current consumption in the LCD device doesn't increase.

Also, since the leakage current generated in the electrostatic dischargers is not applied to the gate and/or data lines, the LCD device can prevent the generation of a horizontal line defect.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

The invention claimed is:

1. A liquid crystal display device having a display area and a non-display area, comprising:

a plurality of gate lines and a plurality of data lines arranged to cross each other on the display area;

a floating line disposed along the periphery of the display area to maintain a floating state;

a common line disposed along the periphery of the floating line to apply a common voltage;

a plurality of first electrostatic dischargers connected between the common line and the floating line;

a plurality of second electrostatic dischargers connected between the floating line and the gate lines; and a plurality of third electrostatic dischargers connected between the floating line and the data lines, wherein the floating line is electrically disconnected from the common line, and wherein no voltage is applied to the floating line and a common voltage is applied to the common line.

2. The liquid crystal display device claimed as claim 1, wherein the floating line, the common line, and the plurality of first to third electrostatic dischargers are all arranged on the non-display area.

3. The liquid crystal display device claimed as claim 1, wherein the plurality of first electrostatic dischargers are connected between the corner portions of the common line and the corner portions of the floating line.

4. The liquid crystal display device claimed as claim 1, wherein the plurality of first electrostatic dischargers are connected between the common and floating lines which are disposed parallel to each other.

5. The liquid crystal display device claimed as claim 1, wherein each of the plurality of first to third electrostatic dischargers includes at least three transistors.

6. The liquid crystal display device claimed as claim 1, wherein the floating line is configured to allow a flow of electric current caused by static electricity.

7. The liquid crystal display device claimed as claim 1, wherein the floating line is configured to prevent the flow of leakage current caused by the common voltage which is applied to the common line.

8. The liquid crystal display device claimed as claim 1, wherein at least one of the floating line and the common line has a closed loop.

9. The liquid crystal display device claimed as claim 1, wherein the floating line is spaced apart from the common line in substantially the same distance.

10. The liquid crystal display device claimed as claim 1, wherein the floating line and the common line are formed on the same substrate.

* * * * *